US007386950B2

(12) United States Patent
Fast et al.

(10) Patent No.: US 7,386,950 B2
(45) Date of Patent: Jun. 17, 2008

(54) LABEL HOLDER

(75) Inventors: Jacob Fast, Boca Raton, FL (US); Michael G. Lowry, Boca Raton, FL (US); Ronald Ross, North Lauderdale, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 228 days.

(21) Appl. No.: 10/725,533

(22) Filed: Dec. 3, 2003

(65) Prior Publication Data

US 2004/0226207 A1 Nov. 18, 2004

Related U.S. Application Data

(60) Provisional application No. 60/438,007, filed on Jan. 6, 2003.

(51) Int. Cl.
*G09F 3/18* (2006.01)

(52) U.S. Cl. ..... 40/661.03; 40/642.02; 40/649

(58) Field of Classification Search ..... 40/649, 40/651, 658, 661.03
See application file for complete search history.

(56) References Cited

U.S. PATENT DOCUMENTS

D347,449 S * 5/1994 Garfinkle ..... D20/43
5,394,632 A 3/1995 Gebka et al.
5,419,066 A * 5/1995 Harnois et al. ..... 40/661.03
5,488,793 A 2/1996 Gebka et al.
5,515,632 A 5/1996 Gebka et al.
5,682,698 A 11/1997 Bevins
6,026,603 A * 2/2000 Kump et al. ..... 40/661.03
6,163,996 A 12/2000 Gebka
6,226,910 B1 * 5/2001 Ireland ..... 40/661.03
6,568,112 B2 5/2003 Lowry et al.

FOREIGN PATENT DOCUMENTS

EP 0 377 772 A 7/1990
EP 0 511 468 A 11/1992

* cited by examiner

*Primary Examiner*—Cassanda Davis
(74) *Attorney, Agent, or Firm*—Jacobson Holman PLLC

(57) ABSTRACT

A versatile label holder adapted to be stably secured in C-channels of various widths such as are found in Lozier, Madix and Streater shelves without significantly modifying the angle normally presented with each of these shelves. The label holder includes a rearwardly extending leg adapted to be captured by the lower lip of the C-channel, a portion of which is resilient and arcuate, extending first upwardly and then downwardly to provide a spring-like element, the effective length of which can vary depending on the spacing between the lips of the C-channel.

12 Claims, 5 Drawing Sheets

LABEL HOLDER

This is a complete application claiming benefit of provisional application Ser. No. 60/438,007 filed Jan. 6, 2003.

BACKGROUND OF THE INVENTION

1. Field of the Invention

This invention relates to price channels of the kind frequently used at the front of merchandise shelves in supermarkets and the like for attaching pricing labels, or signs pertaining to the merchandise on the shelves.

Steel merchandise shelves frequently are made with a C-shaped channel along the front edge in which labels or sign holders can be fitted. Where such shelves are formed without a channel, plastic fittings can be added to the shelves to provide such channels. Price channels can generally be used to accommodate snap-in price labels and sign holders or smaller adhesive backed labels.

When price channels are used, as above, for labeling merchandise on a shelf, no significant problems arise for shelves which are at a convenient viewing height for a customer. For shelves near floor level, and shelves above eye level, however, customers have trouble in reading price channel labels because the labels are generally vertically oriented.

2. Discussion of the Related Art

One known form of extruded plastic snap-in label holder is seen in commonly assigned U.S. Pat. No. 5,394,632 issued Mar. 7, 1995 (the '632 patent) and illustrated herein in FIGS. 1-3. This prior art label holder 10 provides labeling panel 12 oriented at an angle when the price channel is fitted on a lowermost shelf 18 of a set of supermarket or the like shelves as seen in FIG. 3 so that a label is more readily viewed by a customer.

The known label holder 10 includes a rearwardly and downwardly extending leg 14 and a projecting barb 16 at the top of the labeling panel 12. When snapped into an existing C-channel of a metal shelf 18, the barb 16 engages behind the upper lip 20 of the C-channel, the tip of leg 14 engages behind the lower lip 22, and the labeling panel 12 is angled upwardly. As seen in the '632 patent, the price channel 10 can be inverted and snapped into a C-channel on an uppermost shelf to angle the labeling panel downwardly to facilitate viewing from below.

As is well known, label holders of this type are commonly provided with a co-extruded clear plastic front cover 24 providing a means whereby non-adhesive labels can be retained against the labeling panel. The label holder 10 of the '632 patent splits the lower lip 12*b* to enable the channel to hold labels behind the cover and sign holders between the lip 12*b* at the bottom of the labeling panel 12 and the lip 17 at the top thereof.

More recently, combination label/sign holder have been developed wherein labels can be selectively inserted and removed from the label holder pocket without removing any of the sign holders associated with related products on a merchandising shelf. Such a construction is seen in commonly assigned U.S. Pat. No. 6,568,112 issued May 27, 2003 (the '112 patent), the disclosure of which is incorporated herein in its entirety by reference. The sign holder portion of the combination label/sign holder of the '112 patent is carried by, and moves with, the cover member of the label holder, avoiding interfering with access to the label holder pocket. This is accomplished by providing the front surface of the cover member of the label holder with a pair of sign holder-receiving lip members which can snappingly receive edge portions of a resilient plastic or metal sign holder such as seen in the '632 patent or commonly assigned U.S. Pat. No. 5,488,793 for the engaging portions of a depending sign holder of the type seen in commonly assigned U.S. Pat. Nos. 5,682,698 and 6,163,996, the subject matters of all of which are incorporated herein by reference, or other such commercially available sign holders.

For simplicity, the term "label holder" as used herein and in the appended claims is intended to include products which may or may not incorporate a sign holder according to the '112 patent.

Commercially, different merchandisers use sets of product shelves having different integral C-channels along their front edges. The most extensively used shelves of this nature are known in the art as the Lozier shelf, the Madix shelf and the Streater shelf. The C-channels of each of these shelves include the equivalent of an upper, downwardly depending lip and a lower, upwardly extending lip for receipt of upper and lower portions of fit-in accessories such as the label holder of the '632 patent. However, the distance between these lip members, as well as the angle provided by the lip members, are different in each of these types of shelves. While the price channel of the '632 patent can be engaged in the C-channels of each of the Lozier, Madix and Streater shelves, the engagement may be less than secure because of the differences in the spacing between the upper and lower lip members of these shelves, and the relative inflexibility of the rearwardly extending leg 14 which, as seen in FIGS. 1-3 of the '632 patent, extends generally at a right angle from the rear of the labeling panel 12 and arcs downwardly therefrom providing little adjustability to accommodate C-channels of different dimensions. Moreover, when engaged in the C-channels of the different shelf units, the angle of presentation of the label is significantly different from the angle of inclination of a label engaged directly in the C-channels of such shelves. In many instances, this change in the viewing angle makes it more difficult for a customer or the like to read the information on a label carried by the price channel.

SUMMARY OF THE INVENTION

It is an object of this invention to provide a plastic or label holder of the general type described wherein the effective length of one of the C-channel engaging portions, namely the leg extending rearwardly from the back of the labeling panel, is inherently adjustable to accommodate the different dimensions of the Lozier, Madix and Streater merchandising shelves and to enable the label holder portion thereof to follow the angle of the shelf channel and maintain the label holder portion snug against the shelf in a secure manner.

Another object of this invention is to provide a universal or highly versatile label holder or combination label/sign holder wherein the rear leg does not extend outwardly and downwardly directly from the rear of the labeling panel, but first extends upwardly and then downwardly toward the rear of the labeling panel to provide a spring-like action to the rearwardly extending leg, enabling the same to adjust its effective length to accommodate the different dimensions of the C-channels of various shelf sets and to ensure that the label holder portion follows the intended angle of the C-channel of a particular shelf.

Yet another object of this invention is to provide a resilient C-channel engaging rear leg on the labeling panel of a label holder, and to incorporate opposing lips on the front surface of the cover member to provide means to carry a sign holder in a manner that does not interfere with the opening of the cover member to replace or remove labels from the pocket formed between the labeling panel and the front cover.

Additional features and advantages of the invention will become apparent from the ensuing description and claims read in conjunction with the attached drawings.

BRIEF DESCRIPTION OF THE DRAWINGS

The accompanying drawings, which are included to provide a further understanding of the invention and are incorporated in and constitute a part of this specification, illustrate embodiments of the prior art and, together with the description, serve to explain the principles of the invention.

Like reference characters refer to like parts throughout the several views of the drawings.

DETAILED DESCRIPTION OF THE PREFERRED EMBODIMENTS

Figure 7:
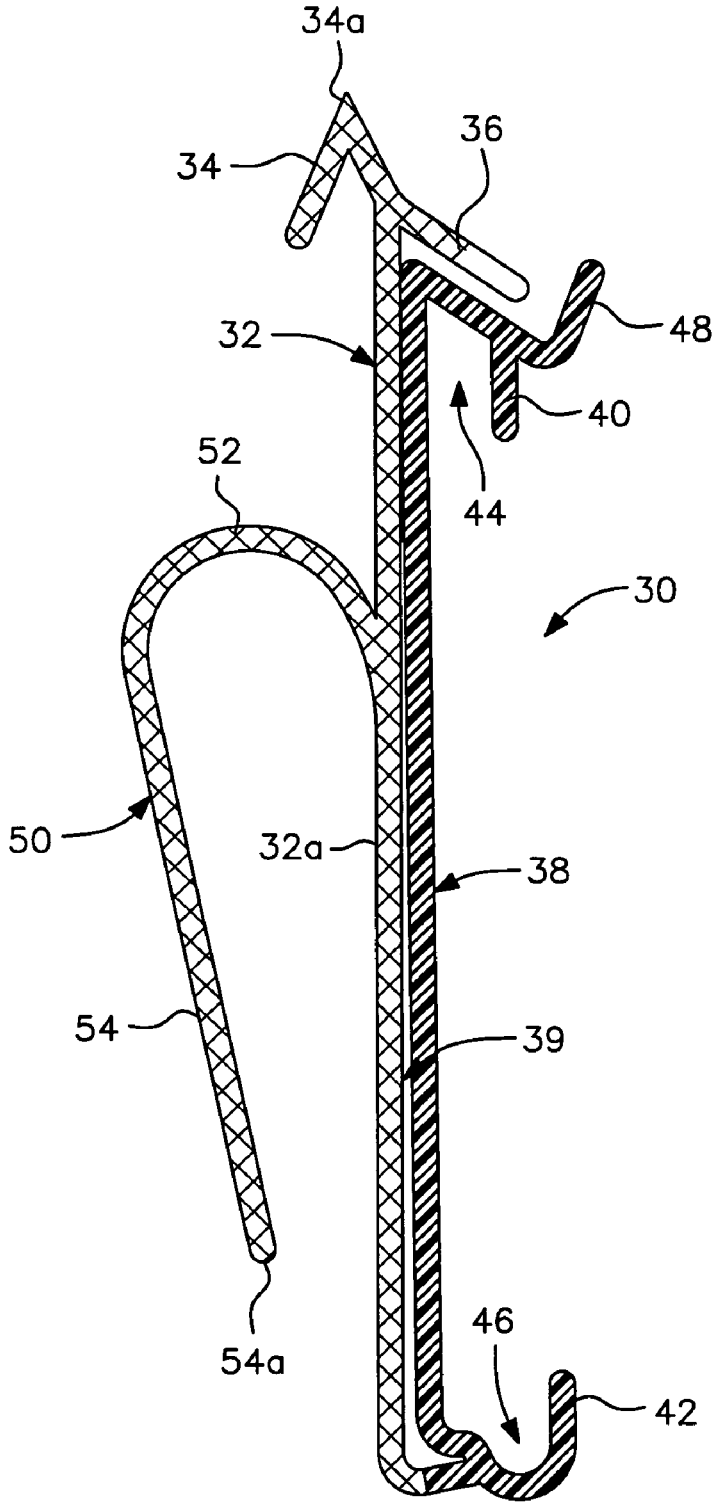
FIG. 7 is a sectional view of a label holder modified according to the instant inventive concepts and incorporating integral sign holder lips on the cover member as described in the '112 patent.

Referring now to FIG. 7, a combination label/sign holder according to a preferred embodiment of this invention is designated generally by the reference numeral 30 and comprises a labeling panel 32 with an upwardly projecting barb or edge portion 34 and a forwardly projecting locking lip 36 similar to the elements seen in the '632 patent. A co-extruded clear plastic front cover 38 provides a pocket 39 whereby non-adhesive labels (not shown) can be retained against the front face or surface of the labeling panel 32 in a well known manner. The front cover 38 and labeling panel 32 are joined at the lower edge portion of the labeling panel 32. Although the instant inventive concepts do not require the incorporation of a sign holder of the type seen in the '112 patent, upper and lower lips 40, 42 may be integrally formed on the cover member 38 to form pockets 44, 46, respectively, for reception of engaging portions of a sign holder in the manner discussed in the '112 patent.

An upwardly and outwardly extending finger engaging element 48 may be provided to facilitate disengaging the upper portions of the cover member 38 from behind the locking lip 36 when it is desired to open the label holder 30 for replacement or removal of a label (not shown) from the pocket 39.

The combination label/sign holder 30 seen in FIG. 7 includes a rearwardly extending leg 50 which is significantly different from the rearwardly extending leg 14 of the prior art price label holder 10. It will be noted that the upper portions 52 of the leg 50 initially extend upwardly from the rear face or surface 32*a* of the labeling panel 32 in an arcuate fashion and then turned downwardly to form a leg 54 which is angled inwardly toward the rear surface 32*a* of the labeling panel 32 and which terminates in a lower or terminal tip 54*a* adapted to engage in the lower, upwardly opening, lip of a C-channel when the upper tip 34*a* of the barb 34 is engaged in the upper, downwardly opening, lip of the C-channel.

Figure 1:
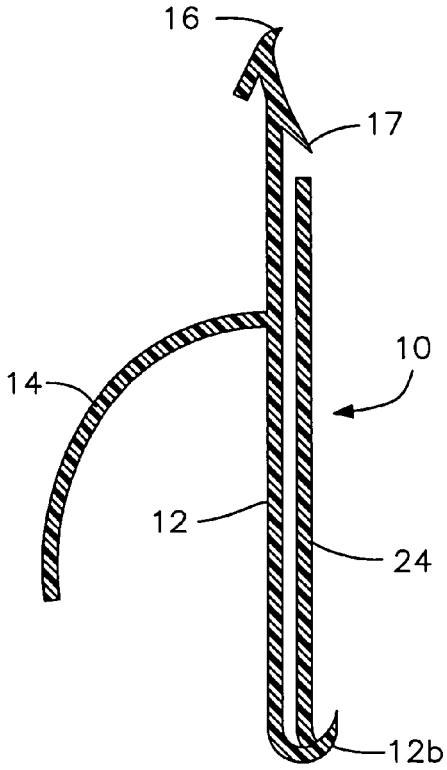
FIG. 1 (PRIOR ART)
FIG. 1 is a sectional view of a prior art label holder of the type seen in the '632 patent.
Figure 2:
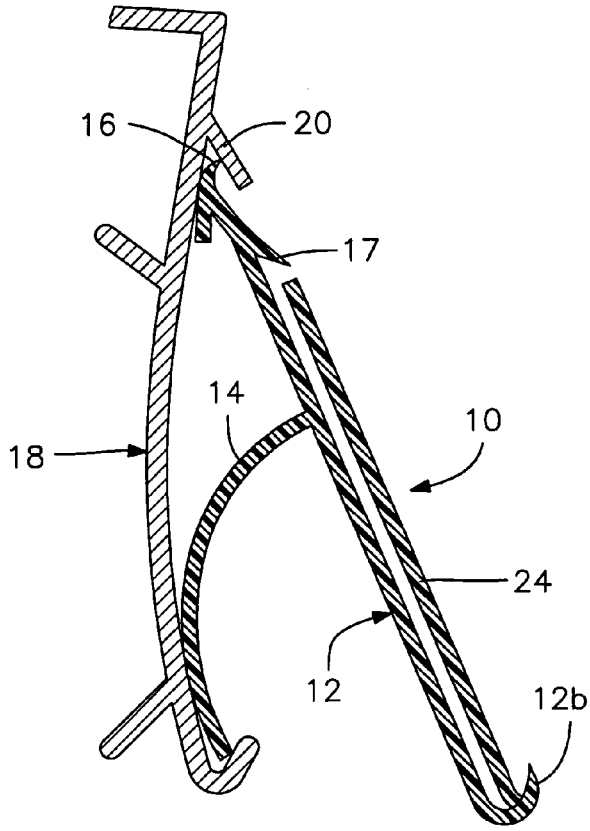
FIG. 2 (PRIOR ART)
FIG. 2 is a sectional view of the prior art label holder of FIG. 1 fitted into a C-channel of a merchandising shelf.
Figure 3:
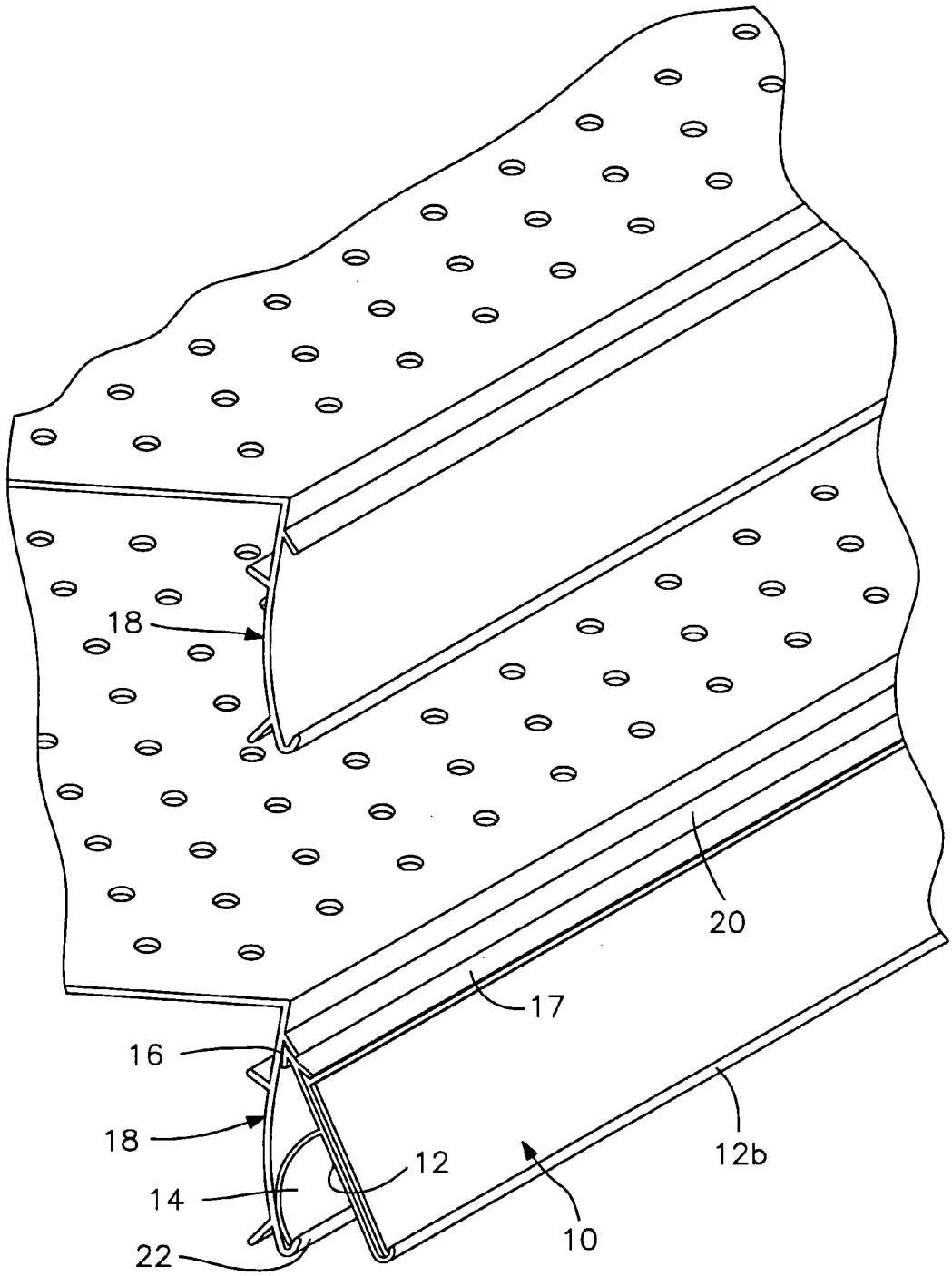
FIG. 3 (PRIOR ART)
FIG. 3 is a perspective view of a set of merchandising shelves with a label holder of the type seen in FIG. 1 engaged in the lowermost shelf close to floor level for upwardly-angled viewing of labels carried thereby.
Figure 4:
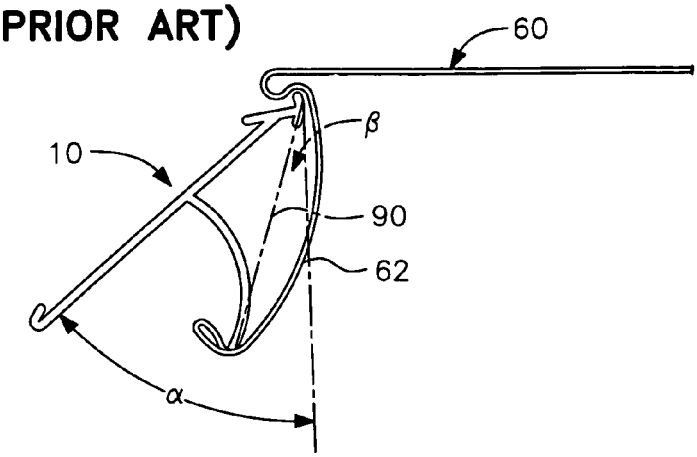
FIG. 4 (PRIOR ART)
FIGS. 4-6 are schematic side elevational views of the prior art label holder of FIG. 1 engaged, respectively, in a Lozier, a Madix and a Streater shelf.
Figure 5:
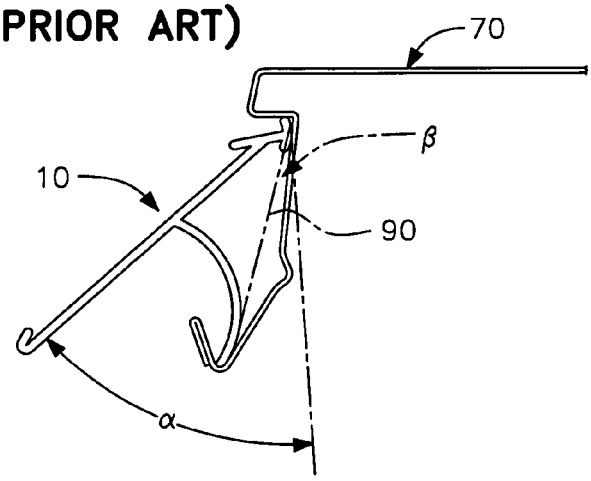
FIG. 5 (PRIOR ART)
Figure 6:
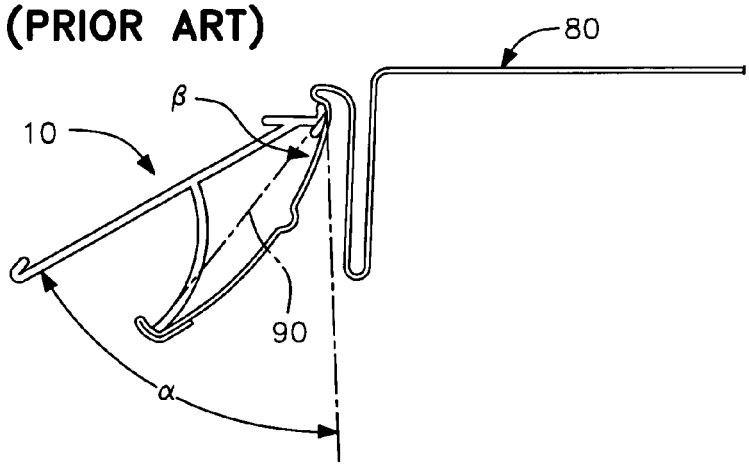
FIG. 6 (PRIOR ART)

FIGS. 4-6 show the manner in which the prior art label holder 10 engages respectively in a Lozier shelf 60, a Madix shelf 70 and a Streater shelf 80. These figures are to be compared to FIGS. 8-10 showing the manner in which the label/sign holder 30 of FIG. 7 engages in Lozier, Madix and Streater shelves of the same construction.

Figure 8:
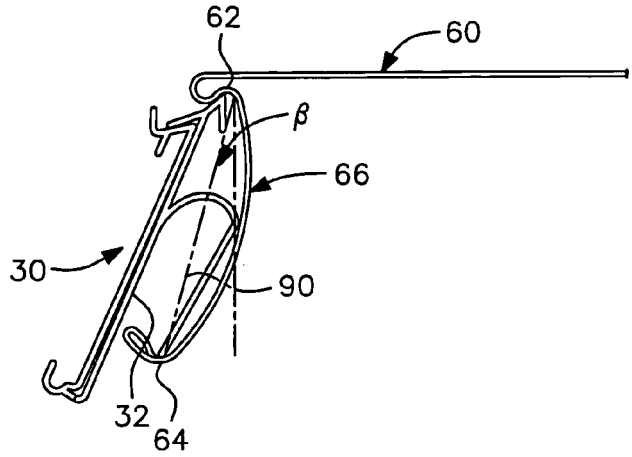
FIGS. 8-10 illustrate the manner in which a label holder or combination label/sign holder according to the instant invention fit within the opposing lips of a C-channel in the Lozier, Madix and Streater shelves, respectively.

As seen in FIG. 8, the distance between the upper lip or pocket 62 and the lower lip or pocket 64 of the Lozier C-channel 66 is on the order of 1.171 inches, whereas, for the Madix shelf 70, the distance between the upper lip 72 and the lower lip 74 of the C-channel 76 is 1.111 inches and for the Streater shelf 80, the distance between the upper lip 82 and the lower lip 84 of the C-channel 86 is 1.197 inches. While, obviously, there are differences among Lozier shelves as well as Madix shelves and Streater shelves based on manufacturing tolerances, these dimensions are given as illustrative. It should be understood that, neither the dimensions of the shelves nor the dimensions of the price channel combination label/sign holder of this invention, are not critical to the instant inventive concepts and can vary significantly without departing therefrom. Of significance, however, is that there is generally a difference in dimensions of the C-channel of these three commercial merchandising shelves.

As seen in FIGS. 4-6, the prior art label holder 10 has only limited flexibility and may accommodate these relatively small differences in C-channel dimensions. However, this limited resilience in the rearwardly extending leg 14 may result in a relatively unstable engagement in particular C-channels whereby the price channel can be easily dislodged if accidentally engaged. Moreover, as will be clearly seen from FIG. 4-6, the design of the label holder 10, with particular reference to the rearwardly extending leg 14, causes the angular presentation of the labeling panel designated "$\alpha$" in each figure to be significantly different from the angular presentation "$\beta$" of data of a label shown in dotted lines at 90 that would be carried directly by the C-channel of the respective shelves. This differential angle distorts the intended presentation of the different merchandising shelves which may make it difficult for customers to view information on labels carried by the prior art label holder 10.

Figure 9:
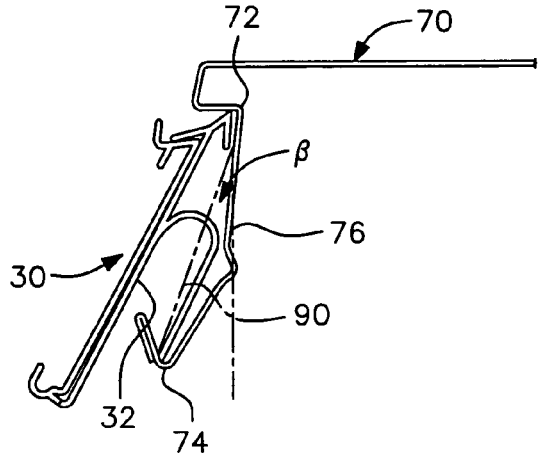
Figure 10:
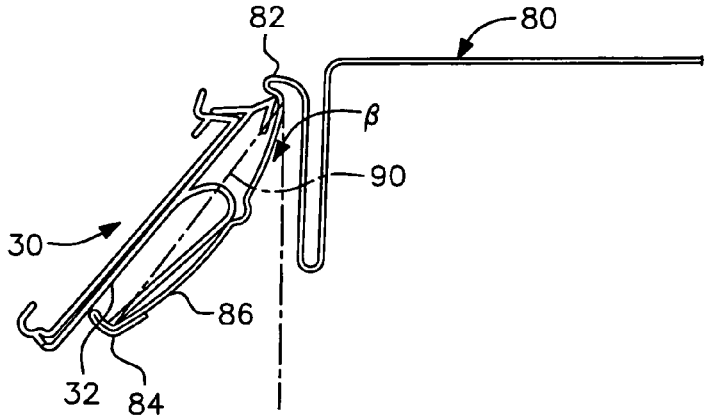

In contrast, with reference to FIGS. 8-10, it will be seen that the angle of the labeling panel 32 of the label holder 30 is quite similar to the angle "$\beta$" of the C-channels 66, 76 and 86, respectively, of the Lozier, Madix and Streater shelves 60, 70 and 80.

Thus, the labeling panel 32 of the label/sign holder 30 of FIG. 7 closely parallels the C-channel of the various shelves whereas the labeling panel 12 of the prior art label holder 10 is significantly increased by the relative inflexibility of the rearwardly extending leg 14. In the label/sign holder 30, the upwardly arcuate portions 52 of the rearwardly extending leg 50 is easily flexed to move the lower tip 54*a* of the leg portion 54 upwardly, as necessary, to accommodate smaller C-channels and thereby provide a secure engagement in C-channels of any of the Lozier, Madix and Streater shelves. This adjustability also permits the labeling panel 52 of the label/sign holder 50 to closely parallel the presentation angle of each of the Lozier, Madix and Streater C-channels thereby avoiding distortion of the label information presented to the customer.

It will now be seen that there is herein provided a label holder or a combination label/sign holder which is universal in that it can readily accommodate different commercially available merchandising shelves and presents information on labels carried thereby to the consumer at an angle consistent with the intended angle of the different merchandising shelves.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to falling within the scope of the invention.

What is claimed is:

1. In a label holder to be fitted into a C-channel wherein the C-channel includes an upper lip defining a downwardly-opening upper pocket and a spaced lower lip defining an upwardly-opening lower pocket, and the label holder includes a labeling panel having upper edge portions adapted to be engaged in the upper pocket of a C-channel, and lower edge portions, a front face adapted to support an information-containing label, and a rear face, and a rearwardly-extending mounting leg having one end portion secured to the rear face of the labeling panel intermediate the upper and lower edge portions of the labeling panel, and a second end portion including a terminal tip adapted to be engaged in the lower pocket of the C-channel, the improvement which comprises said mounting leg including a resilient arcuate portion one end of which is secured to said rear face of said labeling panel, said arcuate portion of said mounting leg initially extending upwardly in a direction toward said upper edge portion of said labeling panel and rearwardly away from said rear face of said labeling panel and then extending arcuately downwardly and angled inwardly in a direction toward said rear face of said labeling panel with said tip thereof terminating in spaced relation to said rear face of said labeling panel to thereby provide spring-like adjustability to the effective length of said mounting leg to accommodate C-channels with different spacings between their upper and lower pockets wherein the spacing between said terminal tip and said rear face of said labeling panel is less than the distance said arcuate portion extends rearwardly from said rear face of said labeling panel, and wherein the distance between the upper edge portion of said labeling panel and said terminal tip is greater than the distance between the upper and lower pockets of the C-channel, whereby the effective length between the upper edge portion of said labeling panel and said terminal tip will adjust in a direction substantially aligned with the rear face of the labeling panel to accommodate different distances between the upper and lower pockets of the C-channel, such adjustability enabled by movement of the terminal tip, and arcing of the arcuate portion, in upward and downward directions substantially aligned with the plane of the rear face to enable a force being exerted between the mounting leg and the C-channel in a direction aligned with the plane of the rear face so as to provide secure gripping within the C-channel.

2. The improvement of claim 1 wherein said label holder further includes a transparent cover member having a front face, a rear face and lower edge portions, said lower edge portions of said cover member being resiliently secured to said lower edge portions of said labeling panel to define a label-receiving pocket between said front face of said labeling panel and said rear face of said cover member.

3. The improvement of claim 2 further including sign-receiving means carried by said front face of said cover member.

4. The improvement of claim 3 wherein said sign-receiving means comprises an upper lip on said front face of said cover member defining a downwardly-opening pocket adapted to receive one part of a sign holder and a spaced lower lip on said front face of said cover member defining an upwardly-opening pocket adapted to resiliently receive a spaced second part of the sign holder.

5. In combination, a C-channel comprising an upper lip defining a downwardly-opening upper pocket and a spaced lower lip defining an upwardly-opening lower pocket, and a label holder comprising a labeling panel having upper edge portions engaged in said upper pocket of said C-channel, and lower edge portions, a front face adapted to support an information-containing label, and a rear face, and a rearwardly-extending mounting leg having one end portion secured to the rear face of said labeling panel intermediate said upper and lower edge portions of said labeling panel, and a second end portion including a terminal tip engaged in said lower pocket of said C-channel, said mounting leg including a resilient arcuate portion one end of which is secured to said rear face of said labeling panel, said arcuate portion of said mounting leg initially extending upwardly in a direction toward said upper edge portions of said labeling panel and rearwardly away from said rear face of said labeling panel and then extending arcuately downwardly and angled inwardly in a direction toward said rear face of said labeling panel with said tip thereof terminating in spaced relation to said rear face of said labeling panel to thereby provide adjustability to the effective length of said mounting leg to accommodate C-channels with different spacings between their upper and lower pockets wherein the spacing between said terminal tip and said rear face of said labeling panel is less than the distance said arcuate portion extends rearwardly from said rear face of said labeling panel, and wherein the distance between the upper edge portion of said labeling panel and said terminal tip is greater than the distance between the upper and lower pockets of the C-channel, whereby the effective length between the upper edge portion of said labeling panel and said terminal tip will adjust in a direction substantially aligned with the rear face of the labeling panel to accommodate different distances between the upper and lower pockets of the C-channel, such adjustability enabled by movement of the terminal tip, and arcing of the arcuate portion, in upward and downward directions substantially aligned with the plane of the rear face and to enable a force being exerted between the mounting leg and the C-channel in a direction aligned with the plane of the rear face so as to provide secure gripping within the C-channel and wherein said labeling panel substantially parallels a line extending between said upper lip and lower lip of said C-channel.

6. The combination of claim 5 wherein said C-channel is formed on the front edge of a merchandise shelf.

7. The combination of claim 6 wherein the shelf is a Lozier shelf.

8. The combination of claim 6 wherein the shelf is a Madix shelf.

9. The combination of claim 6 wherein the shelf is a Streater shelf.

10. The combination of claim 5 wherein said label holder further includes a transparent cover member having a front face, a rear face and lower edge portions, said lower edge portions of said cover member being resiliently secured to said lower edge portions of said labeling panel to define a label-receiving pocket between said front face of said labeling panel and said rear face of said cover member.

11. The combination of claim 10 further including sign-receiving means carried by said front face of said cover member.

12. The combination of claim 11 wherein said sign-receiving means comprises an upper lip on said front face of said cover member defining a downwardly-opening pocket adapted to receive one part of a sign holder and a spaced lower lip on said front face of said cover member defining an upwardly-opening pocket adapted to resiliently receive a spaced second part of the sign holder.

* * * * *